US006126458A

United States Patent [19]

Gregory, II et al.

[11] Patent Number: 6,126,458

[45] Date of Patent: Oct. 3, 2000

[54] BUSSED ELECTRICAL CENTER ASSEMBLY WITH CONNECTOR PRE-SET

[75] Inventors: Jonathan Mark Gregory, II, Ann Arbor; Brian Christopher Schweitzer; Bryan Donald Cole, both of Canton; Brian L. Wagner, Ypsilanti, all of Mich.

[73] Assignee: Yazaki North America, Inc., Canton, Mich.

[21] Appl. No.: 09/353,479

[22] Filed: Jul. 13, 1999

[51] Int. Cl.[7] ..... H01R 12/00

[52] U.S. Cl. ..... 439/76.2; 439/364; 439/553; 439/701

[58] Field of Search ..... 439/553, 362, 439/364, 701, 76.2

[56] References Cited

U.S. PATENT DOCUMENTS

| | | | |
|---|---|---|---|
| 4,954,085 | 9/1990 | Inoue et al. . | |
| 4,956,748 | 9/1990 | Yamamoto et al. . | |
| 4,957,449 | 9/1990 | Hatagishi | 439/364 |
| 5,000,693 | 3/1991 | Hatagishi et al. . | |
| 5,376,016 | 12/1994 | Inaba et al. | 439/364 |
| 5,480,322 | 1/1996 | Ishii et al. . | |
| 5,919,057 | 7/1999 | Kameyama | 439/364 |
| 5,971,796 | 10/1999 | Duhr | 439/445 |
| 6,027,360 | 2/2000 | Jenkins | 439/364 |
| 6,050,839 | 4/2000 | Seminara et al. | 439/364 |

*Primary Examiner*—Paula Bradley
*Assistant Examiner*—Truc Nguyen
*Attorney, Agent, or Firm*—Young & Basile

[57] ABSTRACT

A bussed electrical center (BEC) assembly includes a BEC having a BEC connector on its lower surface, and a lower housing adapted to be secured in position within an automobile engine compartment. Flexible retaining arms extend upwardly from the housing and engage a connector and secure it in a pre-set position in the housing. When the BEC is later mounted to the housing, the connector is automatically aligned with the BEC connector and a shroud extending downwardly from the BEC contacts the retaining arms and deflects them outwardly so that the connector is released from the pre-set position and is free to slide upwardly toward the BEC connector. A bolt passes through the BEC connector and engages a captive nut in the connector so that rotation of the bolt draws the connector upwardly into engagement with the BEC connector. The apparatus permits the BEC to be installed in an automotive vehicle without requiring that the connector be mated with the lower side of the BEC before attaching the BEC to the vehicle.

10 Claims, 4 Drawing Sheets

38
38
36
12c
12b
12a
12b
12c
42
44
58
50
60
64
66
50
60
44
16
36
40
44
50
48
40
42
12

14
52
10
22
20
18
20
28
24
30
16
34
64
46
20
52
22
38
40
12
42
32
38
40
42

BUSSED ELECTRICAL CENTER ASSEMBLY WITH CONNECTOR PRE-SET

FIELD OF THE INVENTION

This invention is directed toward bussed electrical centers (BECs) such as those used in automotive vehicle electrical systems, and more particularly toward a BEC assembly adapted to permit an electrical connector to be mated to the underside of a BEC in a blind assembly operation.

BACKGROUND OF THE INVENTION

Bussed electrical centers (BECs) (also known as power distribution centers or junction blocks) are commonly used in automotive vehicles to simplify electrical system wiring by eliminating multi-branch wiring and consolidating fuses, relays, and other electrical circuit components in a single location. A BEC typically comprises a plastic case having a multitude of sockets formed therein for receiving the circuit components. The case contains bus bars or other conductive means for interconnecting and supplying power to the various circuit components. Electrical connectors are disposed on the BEC to receive mating connectors which terminate wire harness which extend throughout the vehicle to interconnect the circuitry of the BEC with the numerous electrical systems and devices elsewhere in the vehicle.

BECs are often located within the engine compartment of the vehicle, and so are fitted with upper and lower housings to protect the BEC from contaminants such as dirt, water and other debris. The lower housing is typically bolted or otherwise secured to some structure within the engine compartment and thus serves as a mounting bracket for the BEC. Since the BEC must be readily accessible for inspection and servicing, it is normally positioned near the top of the engine compartment with all of the replaceable circuit components disposed on its upper surface beneath an upper housing which is removable to provide access. As the number and complexity of vehicle electrical systems have increased in recent years, the number of circuit components in a BEC has grown to occupy most or all of the surface area on the upper surface of the BEC. Consequently, it has become common practice to locate one or more of the BEC electrical connectors on the lower surface of the BEC, thus freeing more of the upper surface for placement of circuit components.

Some wiring harness connectors are quite large, containing several dozen terminals. In some cases, two or more wiring harness connectors are inserted into a bracket to form one large connector which is then secured to a large, composite BEC connector in a single operation, thus saving time in the assembly process. A large wiring harness connector is usually secured to its mating BEC connector by means of a captive bolt passing through the center of one of the connectors and engaging a nut molded into the mating connector. Tightening the bolt draws the two connectors into electrical contact with one another, an operation that would be difficult to perform by hand due to the large insertion forces that accompany connectors with large numbers of terminals.

It is common practice in the automotive industry for the BEC to be manufactured at a first plant and shipped to a vehicle assembly plant where the BEC is installed in the vehicle and the necessary wire harness connections are made thereto. When a connector is located on the lower surface of the BEC, the limited amount of space in most engine compartments often makes it difficult or impossible to reach the bottom of the BEC and make such a connection after the BEC has been secured in it's operational position in the engine compartment.

Accordingly, connections to the bottom of the BEC are made prior to securing it in the engine compartment. This requires an assembly line worker to hold the BEC upside down, position the wire harness connector in alignment with the mating connector on the lower surface of the BEC, drive the captive bolt into engagement with the nut, then flip the BEC back upright and secure it into its operational position in the engine compartment. This procedure is very awkward and time consuming, and increases the chance of accidental damage to the connectors and other components involved.

SUMMARY OF THE INVENTION

It is an object of this invention to eliminate the need for connectors to be manually mated with the underside of a bussed electrical center (BEC) prior to or concurrently with the BEC being secured within a vehicle.

It is a further object of this invention to provide a housing for a BEC which holds one or more connectors to be mated with the BEC in a pre-set position such that insertion of the BEC into the housing places the BEC connector in alignment with the connector so that mating of the connectors may be easily accomplished.

It is another object of the invention to provide a BEC assembly wherein attaching the BEC to its housing automatically releases the connector from the pre-set position to allow it to move into mating engagement with the BEC connector.

In the preferred embodiment of the invention described and depicted herein, a lower housing of a BEC assembly is adapted to be secured in position within an automobile engine compartment. A plurality of guide members extend upwardly from the lower housing to define a receptacle for receiving a connector, such as a wire harness connector. Flexible retaining arms are formed integrally with certain of the guide members and are positioned to engage the connector and secure it within the receptacle in a pre-set position. When the BEC is later mounted to the housing, the connector in the pre-set position is aligned with a BEC connector on the lower surface of the BEC. Release members extend from the lower surface of the BEC adjacent the BEC connector and are positioned to be in vertical alignment with the retaining arms when the BEC is mounted to the lower housing. As the BEC is urged downwardly toward the lower housing to secure it to the housing, the release members deflect the retaining array from their engaged condition so that the connector is no longer held in the pre-set position, but is free to slide upwardly toward the BEC connector. A bolt passes through the BEC connector and its lower end engages a captive nut in the connector when the BEC is mounted to the housing. An assembly worker rotates the bolt, thus drawing the connector upwardly away from the pre-set position and into electrical engagement with the BEC connector.

In an alternative embodiment of the invention, the receptacle for receiving the wire harness connector comprises walls with windows formed therein. Latch arms are formed on the wire harness connector and have pawls which engage the windows. The pawls have angled lower surfaces which allow the latch arms to flex inwardly as the connector is inserted into the receptacle and snap back outwardly to engage the windows and retain the connector in the pre-set position. The pawls also have angled upper surfaces so that the pawls disengage from the windows and the latch arms flex inwardly to allow the connector to move upwardly away from the pre-set position as the bolt passing through the BEC connector is rotated to draw the connector upwardly into engagement with the BEC connector.

The invention apparatus permits the BEC to be installed in an automotive vehicle without requiring that the connector be mated with the lower side of the BEC before attaching the BEC to the vehicle. Rather, the connector for mating with the lower surface of the BEC is placed in the receptacle in the lower housing where it is held securely by engagement with the retaining arms, and simply mounting the BEC to the lower housing places the two connectors in perfect alignment so that tightening the bolt draws the connector upwardly into mating engagement with the BEC connector. Accordingly, the assembly worker only needs to be able to see and have access to the top surface of the BEC to turn the bolt and make electrical connection.

DETAILED DESCRIPTION OF THE PREFERRED EMBODIMENT

Figure 1:
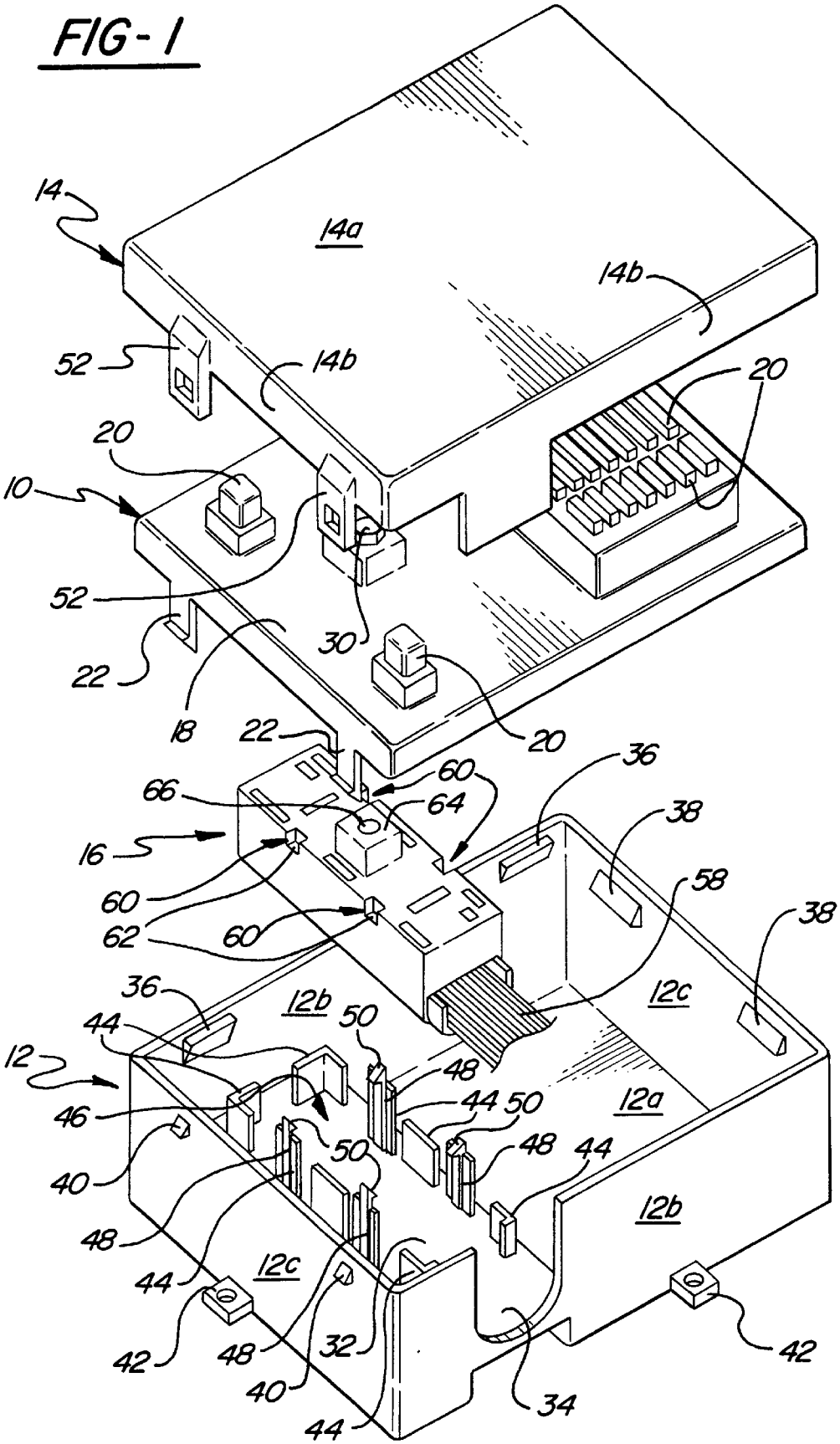
FIG. 1 is an exploded perspective view of a bussed electrical center (BEC) according to the present invention along with a wire harness connector.
Figure 2:
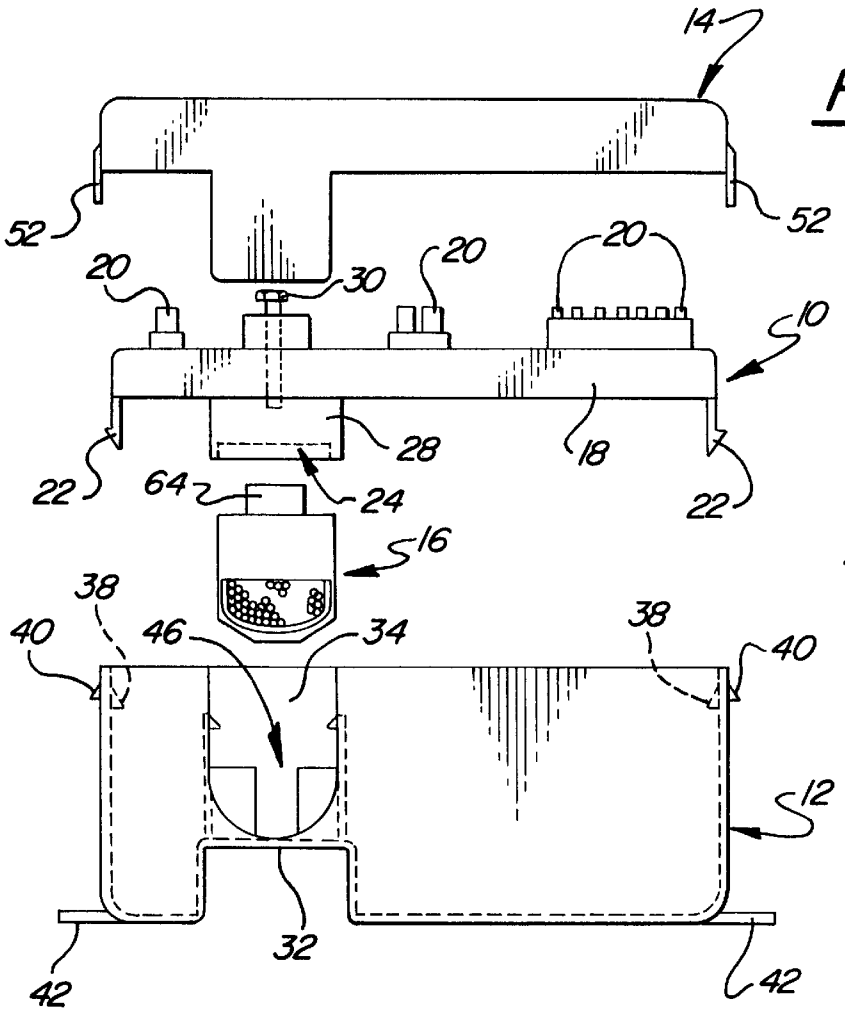
FIG. 2 is an exploded side view of the BEC assembly of FIG. 1.

As seen in FIGS. 1 and 2, a bussed electrical center (BEC) assembly according to the present invention comprises a BEC 10, a lower housing 12, and an upper housing 14. A wire harness connector 16 is shown for mating engagement with the BEC 10, but is to be understood that other types and numbers of electrical connectors may be employed in conjunction with the invention.

The BEC 10 is generally conventional in construction insofar as it comprises a molded plastic case 18 having an upper surface with a plurality of sockets formed therein for receiving electrical circuit components 20 such as fuses and relays. The case 18 contains bus bars or other conductive means (not shown) for supplying power to the various circuit components 20 and interconnecting them into their respective circuits. Latch tabs 22 extend downwardly from the BEC case 18 at opposite ends thereof.

Figure 5:
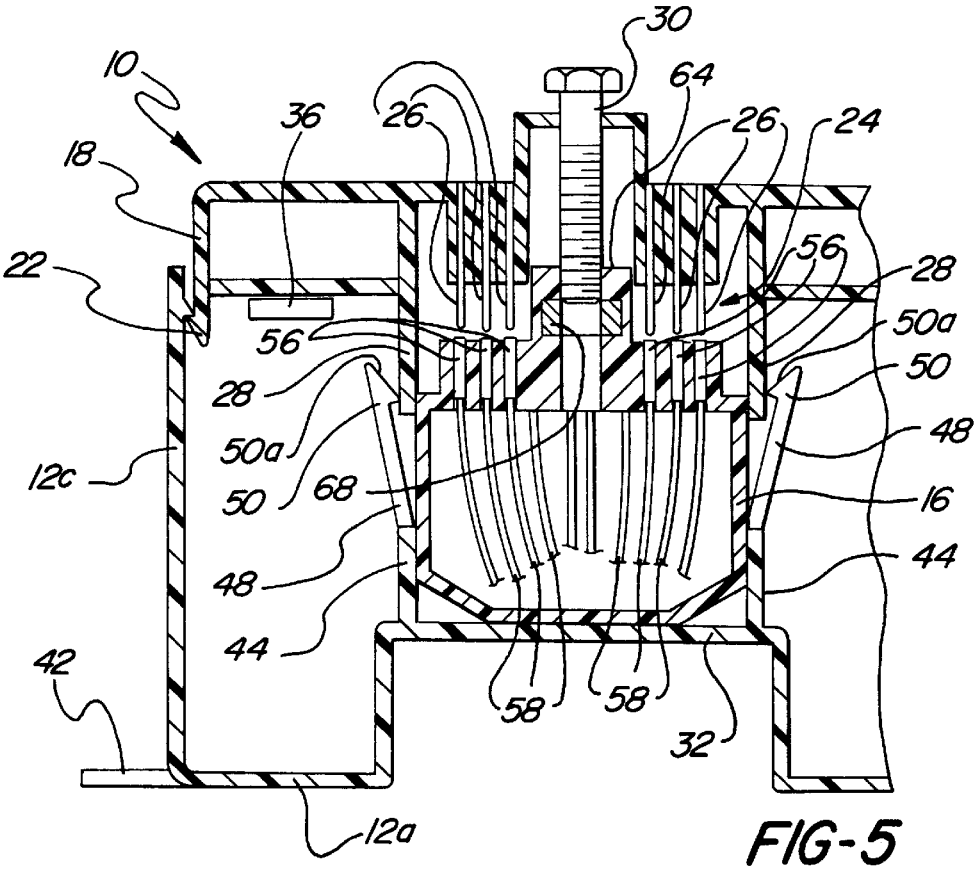
FIG. 5 is a cross-section view taken on line 5—5 of FIG. 4.

A multi-pin BEC connector 24 is molded integrally with the BEC case 18 and extends downwardly from a lower surface thereof (see FIG. 5). The BEC connector 24 comprises a plurality of terminals 26 oriented perpendicularly to the surface of the BEC 10 and which are electrically connected with the conductive means within the BEC 10. A shroud 28 extends downwardly from the lower surface of the BEC 10 and surrounds the lower ends of the BEC connector 24. A bolt 30 passes through a hole in the BEC connector 24, with the head of the bolt accessible on the top surface of the BEC 10. It is within the scope of the invention for additional connectors to be disposed on any of the surfaces of the BEC 10.

The lower housing 12 is preferably formed of a plastic material by injection molding and comprises a bottom wall 12*a*, two side walls 12*b* and two end walls 12*c*. A raised platform 32 is formed as part of the bottom wall 12*a*, and an aperture 34 is located in the side wall 12*b* adjacent one end of the platform 32. Support ledges 36 are disposed at several locations on inner surfaces of the side walls 12*b*, and lock blocks 38 are formed at several locations on inner surfaces of the end walls 12*c*. Latch projections 40 are located on the outer surfaces of the end walls 12*c*. Mounting tabs 42 extend from the lower housing 12 at several locations therearound.

A plurality of guide members 44 extend upwardly from the platform 32 to define a generally rectangular receptacle 46 having an open upper end. Two retaining arms 48 are located on each side of the platform 32. Each retaining arm 48 has a pawl 50 at its upper end, the pawls 50 having angled surfaces 50*a* (see FIG. 5) which slope downwardly and toward the interior of the receptacle 46. In the preferred embodiment, each retaining arm 48 is formed integrally with a guide member 44.

The upper housing 14 comprises a top wall 14*a* and a flange 14*b* extending downwardly therefrom around the perimeter of the top wall. A plurality of latch tabs 52 extend downwardly from the flange 14*b* and are positioned to engage the latch projections 40 disposed on the lower housing 12 to secure the two housings together.

The wire harness connector 16 is generally rectangular in overall configuration and has a plurality of electrical terminals 56 retained in chambers adjacent the mating face of the connector. The terminals 56 are crimped to wires 58 which extend through the interior of the connector 16 and out an opening in its end. Four channels 60 extend vertically downwardly from the mating face along the side walls of the connector to define flat surfaces 62 at the lower ends of the channels 60. A square post 64 is located in the approximate center of the connector and has a hole 66 extending therethrough. A nut 68 is molded into the post 64 in alignment with the hole 66.

During installation of the BEC 10 assembly in a vehicle, the lower housing 12 is first secured in place in the engine compartment or other location in the vehicle by means of the mounting tabs 42. The wire harness connector 16 is then secured in the lower housing 12 by positioning the connector above the platform 32 with the mating surface oriented upwardly and urging it downwardly to slide it into the receptacle 46 formed by the guide members 44 so that the wires exiting the end of the connector extend through the aperture 34 in the side wall of the lower housing 12.

Figure 3:
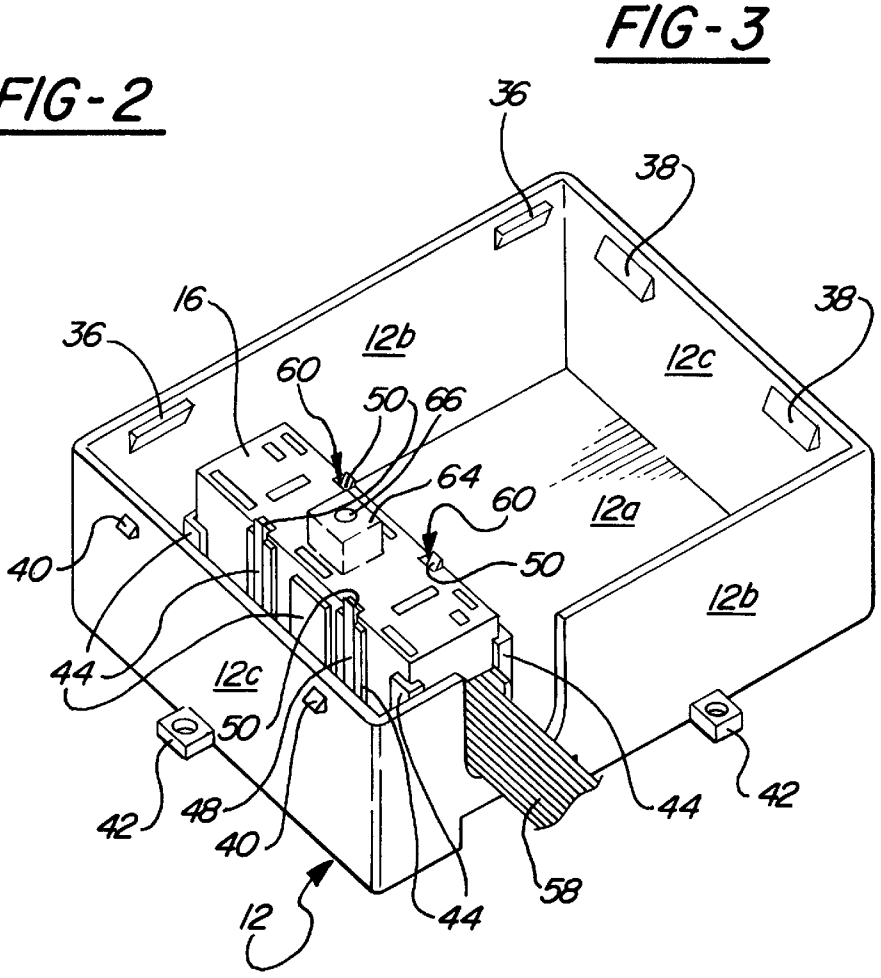
FIG. 3 is a perspective view showing the wire harness connector in a pre-set position within the lower housing.

As the wire harness connector 16 slides downwardly into the receptacle 46, the lower corners of the connector contact the angled surfaces 50*a* of the pawls so that the retaining arms 48 are deflected outwardly to allow the connector to pass therebetween. When the connector 16 is fully inserted into the receptacle 46, the retaining arms 48 snap back inwardly so that the pawls 50 engage the flat surfaces 62 at the lower ends of the channels 60 in the side walls of the connector to secure the connector 16 in the pre-set position. See FIG. 3

Figure 4:
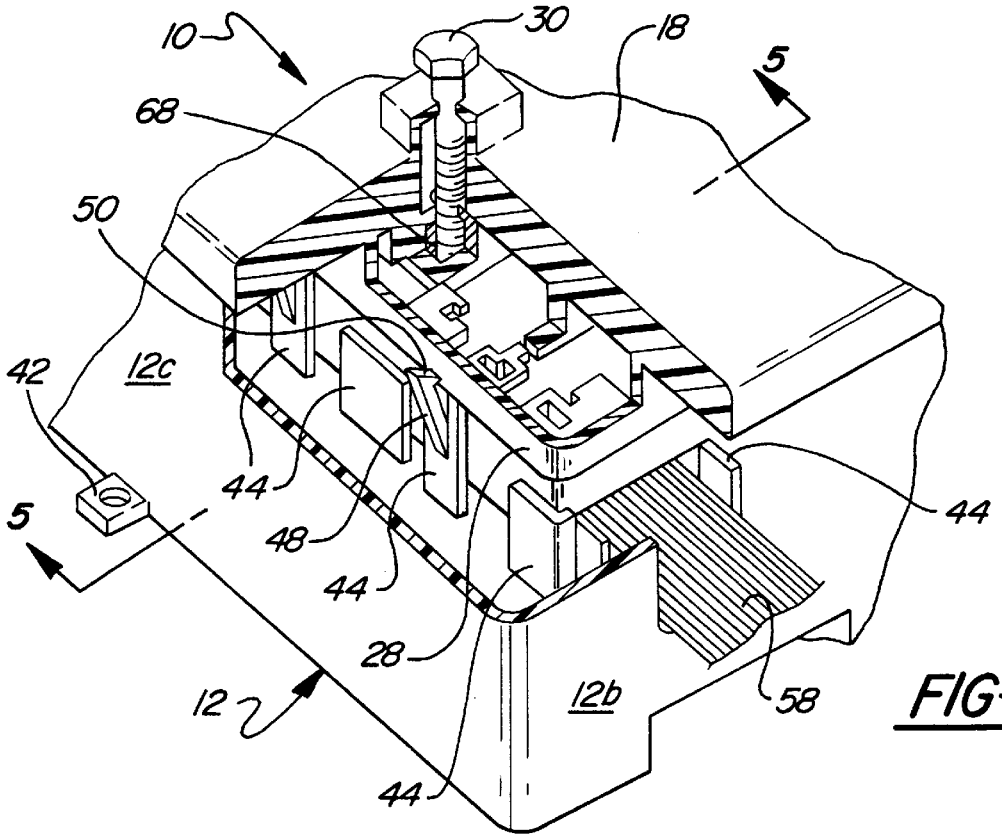
FIG. 4 is cut-away partial perspective view showing the BEC inserted into the lower housing to release the retaining arms from engagement with the wire harness connector.

Next, the BEC 10 is mounted to the lower housing 12 by sliding it downwardly into the housing until the lower edge of the case 18 rests on the support ledges 36 and the latch tabs 22 on the BEC 10 snap into engagement with the lock blocks 38 on the inner surfaces of the housing end walls 12*c* to latch the BEC 10 into connection with the lower housing. As the BEC 10 is urged downwardly into the lower housing 12, the lower end of the shroud 28 comes into contact with the angled inner surfaces 50*a* of the pawls thereby deflecting the retaining arms 48 outwardly so that the pawls 50 are disengaged from the flat surfaces 62 on the connector. The lower end of the bolt 30 passes downwardly into the hole 66 in the center post 64 of the connector. See FIGS. 4 and 5.

Figure 6:
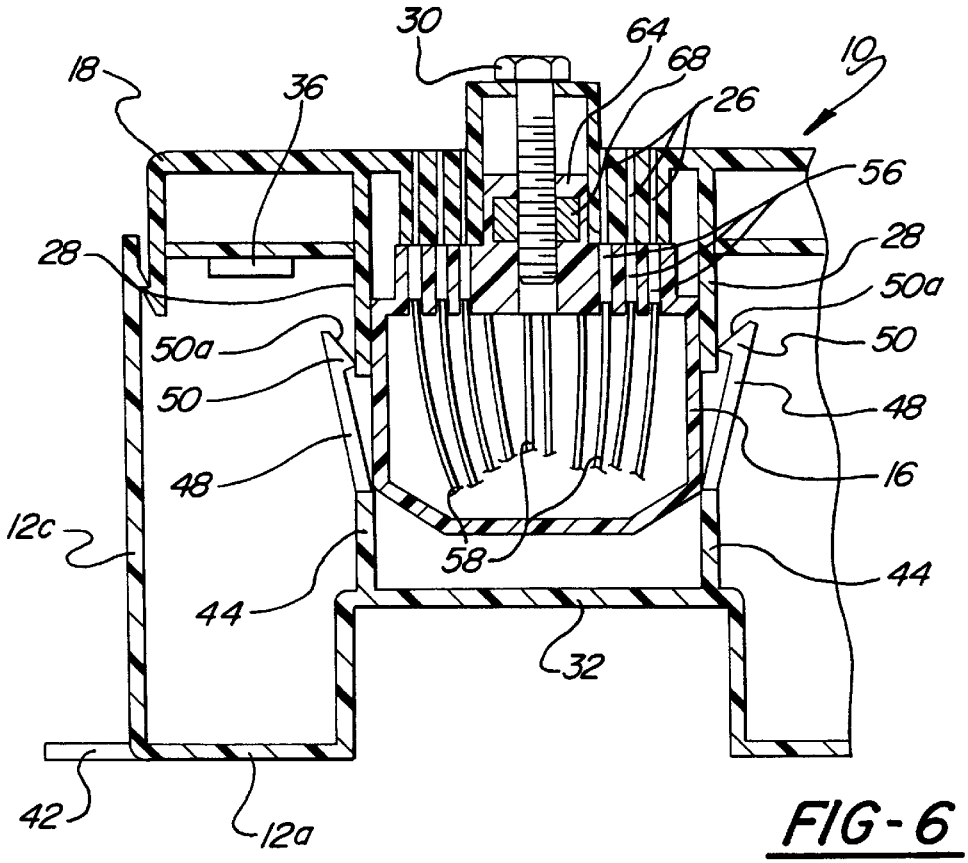
FIG. 6 is a cross-section view showing the wire harness connector drawn upwardly into engagement with the BEC.

The bolt 30 is then driven downwardly by the assembly worker, preferably using a powered wrench, so that the bolt 30 engages the molded-in nut 68 in the wire harness connector 16 and draws the wire harness connector upwardly toward the BEC 10 and into mating engagement with the BEC connector 24, as seen in FIG. 6. The upper housing 14 is then placed over the BEC 10 and latched into engagement with the lower housing 12 to complete the assembly procedure.

In accordance with the present invention, one or more connectors may be inserted into pre-set positions within the lower housing 12 so that they are securely held therein and properly positioned to come into alignment with mating connectors 24 on the BEC 10 when the BEC is mounted to the lower housing 12. The connectors are then mated with the BEC connectors 24 in a blind operation without an assembly worker having to see or manually manipulate the underside connectors.

Figure 7:
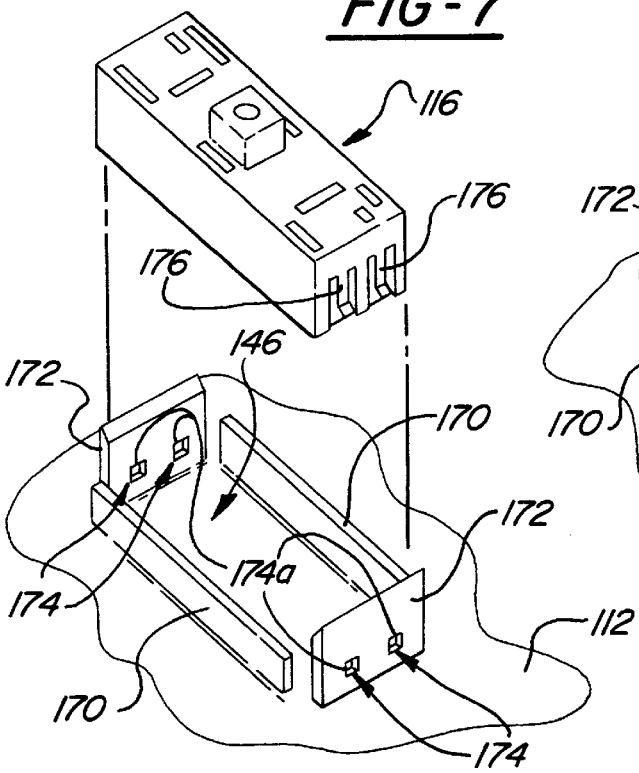
FIG. 7 is a partial perspective view of a receptacle and wire harness according to an alternative embodiment of the invention.
Figure 8:
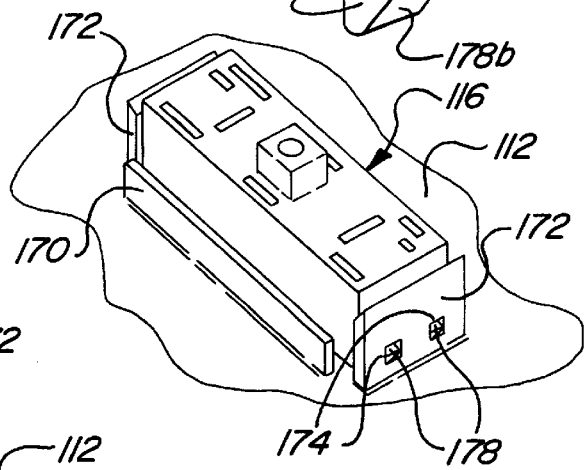
FIG. 8 is a perspective view showing the wire harness connector of FIG. 7 in a pre-set position within the receptacle.

FIGS. 7 and 8 depict an alternative embodiment of the invention comprising a wire harness connector 116 and a lower housing 112 having means for engaging one another which differ from those of the first disclosed embodiment. A generally rectangular receptacle 146 for receiving the connector 116 is defined by side walls 170 and end walls 172 and projects upwardly from the lower housing bottom wall 112. The top edges 172*a* of the end walls are bevelled so that they slope downwardly and toward the interior of the receptacle 146. Windows 174 are formed in each of the end walls 172 to define latching surfaces 174*a* at the upper edge of each window. The latching surfaces 174*a* are bevelled so that they slope upwardly and toward the interior of the receptacle 146.

Figure 9:
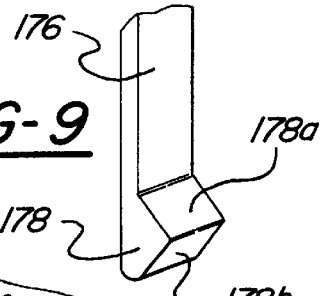
FIG. 9 is a detail view showing a latch arm of the connector of FIGS. 7 and 8.

Two latch arms 176 are disposed at each end of the wire harness connector 116. The latch arms 176 are attached to the connector body at their upper ends and have triangular pawls 178 adjacent their lower ends (see FIG. 9). The pawls 178 have upper surfaces 178*a* which are angled downwardly and away from the connector, and lower surfaces 178*b* which are angled upwardly and away from the connector. In FIGS. 7 and 8, the terminals and wires that normally are contained in and associated with the connector are not shown for clarity.

A BEC (not shown in FIGS. 7 and 8) is generally similar to that described in relation to the first embodiment, having a BEC connector with a captive bolt passing through the center thereof. For reasons that will become apparent from the description to follow, it is not necessary for the BEC connector to have a shroud surrounding and extending downwardly beyond the lower ends the terminals of the BEC connector.

After the housing 112 has been secured to the vehicle, the wire harness connector 116 is inserted downwardly into the receptacle 146. The lower surfaces 178*b* of the pawls contact the top edges 172*a* of the end walls. The angle of the pawl lower surface 178*b* preferably matches the angle of the end wall top edge 172*a* so that the two surfaces meet substantially flush with one another. As the connector 116 is urged downwardly, the latch arms 176 flex inwardly so that the pawl lower surfaces 178*b* are forced inwardly as they slide downwardly over the end wall top edges 172*a*, allowing the connector 116 to move downwardly into the pre-set position. When the connector 116 is fully seated in the receptacle 146, the latch arms 176 snap back outwardly so that the pawls 178 engage their respective windows 174 and secure the connector in the pre-set position, as shown in FIG. 8.

The BEC is then inserted downwardly into the lower housing 112 such that the captive bolt projects into the hole 166 in the center post 164 of the wire harness connector 116 and engages a molded-in nut (not shown). The bolt is rotated by the assembly worker, as in the first embodiment, to draw the wire harness connector 116 upwardly toward the BEC connector. The angle of the pawl upper surface 178*a* preferably matches the bevel angle of the latching surface 174*a* so that the two surfaces meet substantially flush with one another. The pawl upper surfaces 178*a* slide inwardly over the latching surfaces 174*a* as the connector 116 is drawn upward, thus forcing the latch arms 176 to deflect inward and releasing the pawls 178 from their engagement with the windows 174.

In this embodiment of the invention, there is no need for a shroud or other member extending from the BEC to release the wire harness connector from its pre-set position. This configuration may be advantageous for manufacturing reasons. When forming injection molded parts having thin walls, it is generally more difficult to maintain tolerances on a large part than on a small part due to problems with warpage. Forming the latch arms 176 as part of the connector 116, rather than the larger BEC or lower housing 112, therefore makes it easier to mass produce parts having the required dimensional accuracy to ensure proper fit and functioning of the parts.

The configuration of the latch arms 176 and windows 174 may be varied without departing from the scope of the invention, as many equivalent ways to provide a releasable engagement between the connector 116 and the lower housing 112 will be apparent to one of skill in the art. For example, latch arms may be provided on the receptacle to engage latching surfaces on the connector.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. An electrical power distribution center comprising:

a bussed electrical center (BEC) housing for mounting to a vehicle;

a receptacle disposed on the BEC housing for engaging a wire harness connector to maintain the connector in a pre-set position within the BEC housing;

a BEC mountable to the BEC housing such that the BEC housing encloses a lower surface of the BEC;

a BEC connector disposed on the lower surface of the BEC for alignment with the wire harness connector when the BEC is mounted to the BEC housing, the BEC connector adapted for mating electrical engagement with the wire harness connector;

at least one release member disposed on the BEC for contacting the receptacle so as to disengage the receptacle from the wire harness connector when the BEC is mounted to the BEC housing; and a bolt on the BEC and engagable with the wire harness connector to draw the wire harness connector away from the pre-set position and into mating engagement with the BEC connector.

2. The electrical power distribution center of claim 1 wherein the receptacle comprises at least one retaining arm extending from the BEC housing and having a distal end with an angled surface, and the release member is configured to contact the angled surface to urge the retaining arm to a deflected position wherein the retaining arm does not engage the wire harness connector.

3. An electrical power distribution center comprising:

a bussed electrical center (BEC) housing for mounting to a vehicle;

a receptacle disposed on an upward-facing inner surface of the BEC housing and engagable with a wire harness connector to maintain the connector in a pre-set position wherein a mating surface of the connector is oriented upwardly;

a BEC mountable to the BEC housing such that a lower surface of the BEC is enclosed by the BEC housing;

a BEC connector disposed on the lower surface of the BEC to be positioned directly above and in alignment with the wire harness connector when the BEC is mounted to the BEC housing, the BEC connector adapted for mating electrical engagement with the wire harness connector;

at least one release member extending downwardly from the BEC to contact the receptacle when the BEC is mounted to the BEC housing, said contact disengaging the receptacle from the wire harness connector; and means on the BEC for engaging the wire harness connector and drawing the wire harness connector upwardly away from the pre-set position and into mating engagement with the BEC connector.

4. The electrical power distribution center of claim 3 wherein the receptacle comprises at least one retaining arm extending from the BEC housing and having a distal end for engaging the wire harness connector.

5. The electrical power distribution center of claim 4 wherein the releasing means comprises at least one member projecting from the BEC to contact the distal end of the retaining arm when the BEC is engaged with the BEC housing and urge the retaining arm to a deflected position wherein the distal end of the retaining arm does not engage the wire harness connector.

6. The electrical power distribution center of claim 5 wherein the distal end of the retaining arm has an angled surface and the release member contacts the angled surface to urge the retaining arm to the deflected position.

7. The electrical power distribution center of claim 3 wherein the means for engaging the connector comprises a bolt passing through the BEC connector and engageable with a nut secured to the wire harness connector.

8. An electrical power distribution center assembly comprising:

a bussed electrical center (BEC) housing for mounting to a vehicle;

a wire harness connector for terminating a wire harness of the vehicle and having at least one latching pawl movable between a first position wherein the pawl is extended with respect to the connector and a second position wherein it is retracted with respect to the connector;

a receptacle disposed on the BEC housing for receiving the wire harness connector and having at least one member defining a latching surface engageable with the latching pawl when the latching pawl is in the extended position, said engagement maintaining the connector in a pre-set position within the BEC housing;

a BEC mountable to the BEC housing such that the BEC housing encloses a lower surface of the BEC;

a BEC connector disposed on the lower surface of the BEC for alignment with the wire harness connector when the BEC is mounted to the BEC housing, the BEC connector adapted for mating electrical engagement with the wire harness connector;

means on the BEC for moving the wire harness connector away from the pre-set position and toward mating engagement with the BEC connector, the latching pawl being urged to the retracted position by contact with the latching surface as the wire harness connector moves away from the pre-set position.

9. The electrical power distribution center of claim 8 wherein the latching pawl has an upper surface which contacts the latching surface at an angle oblique to the direction of movement of the wire harness connector, whereby the movement of the connector causes the latching pawl upper surface to slide over the latch surface as the pawl moves to the retracted position.

10. The electrical power distribution center of claim 9 wherein the latching pawl is disposed on a flexible latch arm.

* * * * *

UNITED STATES PATENT AND TRADEMARK OFFICE

CERTIFICATE OF CORRECTION

PATENT NO. : 6,126,458

DATED : October 3, 2000

INVENTOR(S) : Gregory, II, et al

It is certified that error appears in the above-identified patent and that said Letters Patent is hereby corrected as shown below:

Column 2, Line 44, delete "array" and insert -- arms away --

Signed and Sealed this

First Day of May, 2001

*Attest:*

Nicholas P. Godici

NICHOLAS P. GODICI

*Attesting Officer*

*Acting Director of the United States Patent and Trademark Office*